US005527251A

United States Patent [19]

Davis

[11] Patent Number: 5,527,251

[45] Date of Patent: Jun. 18, 1996

[54] COMPRESSIBLE FLUID-BASED, ADJUSTABLE RESISTANCE HYDRAULIC SYSTEM FOR EXERCISE EQUIPMENT

[76] Inventor: Leo W. Davis, 15711 Regal Hill Cir., Dallas, Tex. 75248

[21] Appl. No.: 319,875

[22] Filed: Oct. 7, 1994

[51] Int. Cl.[6] ..... A63B 21/008

[52] U.S. Cl. ..... 482/112; 482/113; 482/51

[58] Field of Search ..... 482/112, 113, 482/51, 53

[56] References Cited

U.S. PATENT DOCUMENTS

| | | | |
|---|---|---|---|
| 4,257,593 | 3/1981 | Keiser | 482/113 |
| 4,441,708 | 4/1984 | Brentham | 482/112 |
| 4,609,190 | 9/1986 | Brentham | 482/113 |
| 4,645,200 | 2/1987 | Hix . | |
| 4,850,585 | 7/1989 | Dalebout . | |
| 4,928,957 | 5/1990 | Lanier et al. | 482/113 |
| 4,934,690 | 6/1990 | Bull | 482/53 |
| 4,940,233 | 7/1990 | Bull et al. . | |
| 4,989,858 | 2/1991 | Young et al. . | |
| 5,026,046 | 6/1991 | Decloux | 482/113 |
| 5,104,363 | 4/1992 | Shi . | |
| 5,207,621 | 5/1993 | Koch et al. | 482/113 |
| 5,318,490 | 6/1994 | Henderson et al. | 482/53 |
| 5,346,452 | 9/1994 | Ku | 482/113 |

*Primary Examiner*—Lynne A. Reichard
*Attorney, Agent, or Firm*—Hitt Chwang & Gaines

[57] ABSTRACT

A hydraulic system for exercise equipment and a method of providing resistance to piston motion in exercise equipment. The hydraulic system comprises: (1) a first piston in a first cylinder dividing an interior of the first cylinder into first and second chambers and having an end portion substantially sealing the first chamber of the first cylinder against fluid communication with the environment, the first cylinder further having a first fluid port, (2) a second piston in a second cylinder dividing an interior of the second cylinder into first and second chambers and having an end portion substantially sealing the first chamber of the second cylinder against fluid communication with the environment, the second cylinder further having a first fluid port, (3) an adjustable valve having a first valve fluid port coupled to the first fluid port of the first cylinder and a second valve fluid port coupled to the first fluid port of the second cylinder, (4) means for controllably adjusting a fluid resistance of the adjustable valve and (5) a compressible fluid substantially occupying the first chambers of the first and second cylinders.

18 Claims, 7 Drawing Sheets

COMPRESSIBLE FLUID-BASED, ADJUSTABLE RESISTANCE HYDRAULIC SYSTEM FOR EXERCISE EQUIPMENT

TECHNICAL FIELD OF THE INVENTION

The present invention is directed, in general, to compressible fluid-based hydraulic systems and more specifically to a compressible fluid-based hydraulic system for exercise equipment capable of providing bidirectional, adjustable resistance to a user's effort.

BACKGROUND OF THE INVENTION

Over the last two decades, emphasis has been placed on the importance of regularly exercising the human body. Medical science has established that enormous benefits can be achieved from regular exercise, such as reduction of in an individual's cholesterol level, reduction of overall body fat and stronger, healthier heart and lungs. In fact, it has been shown that one of the best forms of exercise involves one that provides the body with a thorough "aerobic" workout by providing an adequate amount of resistance that allows the user to sustain a rapid heart rate for an extended period of time of between 20 to 40 minutes.

Various types of exercise equipment designed to provide the user with such aerobic resistance machines have been developed and are well known in the art. For instance, one type of exercise equipment employed by individuals to aerobically exercise the body is free weights or "bar bells." While this can provide the user with an excellent form of variable weight resistance and aerobic activity, free weights suffer from several disadvantages. For instance, free weights are both heavy and bulky. Moreover, to perform the different types of exercise presently recommended by physical fitness experts, the user must be able to use the weights in diverse lifting motions, many of which cannot be performed using free weights. Additionally, the user must either have several weight amounts set up at any given time so that the user can move quickly from one exercise to another, or the user must stop each time and change the weights out for the next exercise—a stop that greatly inhibits the aerobic benefits of the workout. To overcome these disadvantages, rack weight machines have been provided that are assembled to allow the user to easily move from one weight station to another and quickly set the weight amounts, thereby providing a machine that is capable of delivering a resistance/aerobic workout. However, these machines are also often bulky, heavy and take up a significant amount of space.

Over the years, exercise machines have undergone vast changes in an attempt to provide the user with an exercise machine that is capable of providing the user with a compact, light-weight form of resistance and simultaneously give the user a good aerobic workout. These devices typically employ diverse forms of mechanical apparatus to achieve these goals, such as bicycling, rowing, jogging, striding and stair climbing apparatus. For example, U.S. Pat. Nos. 4,645,200 to Hix; No. 4,989,858 to Young, et al.; No. 5,104,363 to Shi; No. 4,850,585 to Dalebout; and No. 4,940,233 to Bull, et al. generally illustrate these types of apparatus. The patent to Dalebout U.S. Pat. No. 4,850,585 discloses a striding-type apparatus. The Dalebout apparatus includes a frame and a pair of reciprocating leg members that support a user above a supporting surface, such as a floor. The user stands on foot supports connected to the leg members and moves his legs in a striding-type reciprocating motion. A pair of handle members may also be associated with the leg members to rotate simultaneously therewith. A reciprocation mechanism may be provided to force opposite rotation of the leg and arm members with respect to each other. However, such striding-type apparatus have distinct disadvantages. First, they typically provide resistance in only one direction, particularly with respect to the upper body. Second, they do not closely simulate the natural striding movements of both the arms and legs during walking, as the feet are forced to travel in a straight line, rather than in an arc about the user's hip joint.

Some of the more recently developed machines use a resistance that is created by a complex system of electronically actuated brake-type devices that are controlled by microprocessors. Although these systems can provide the user with a resistance and aerobic workout, they suffer from the disadvantage that they are susceptible to mechanical failure and regular maintenance requirements due to their complex integrated mechanical and electronic design.

Many of the other apparatus previously mentioned, which provide the user with resistance and aerobic forms of exercise, incorporate the use of hydraulic of resistance cylinders. Generally, these hydraulic cylinders use incompressible hydraulic fluids to form the resistance against which the user exerts himself. While, these devices are typically compact and light weight, they too have disadvantages associated with their use. For example, they typically provide the user with resistance in only one direction. Thus, the user cannot achieve a maximum resistance and aerobic benefit during the time in which he is using the machine.

Another disadvantage lies within the hydraulic cylinders that are typically employed in such devices. The hydraulic cylinders generally used are conventional shock absorbing-type cylinders. For example, a typical structure of such a device includes a cylinder having a piston disposed therein, the piston having a fluid port therethrough and attached to a rod extending externally from the cylinder that is mechanically attached to a lever arm. The cylinder has an incompressible hydraulic fluid or oil within the cylinder that is forced from one end of the cylinder to the other via the fluid port in the piston as the piston is reciprocated within the cylinder. During use, the hydraulic fluid's temperature increases due to the friction that is created from the fluid being forced back and forth through the piston's fluid port. Since the fluid is confined to a rather small volume with little surface area, the heat is not easily dissipated from the fluid. Thus, the temperature of the fluid quickly increases and, since hydraulic fluids have a positive viscosity index, the heat quickly breaks down the fluid's viscosity. The resistance of the cylinder is thus decreased because the fluid moves more easily through the fluid ports in the piston, and the resistance and aerobic benefits to the user are decreased, as well. Moreover, the lower viscosity may also cause the fluid to leak from the seals in the cylinder.

Another disadvantage of the conventional exercise hydraulic systems is that the fluid ports cannot easily be adjusted to change the resistance of the hydraulic system. Typically, to change the resistance, the user must interrupt his exercise routine and manually adjust the mechanical advantage of the lever arm with respect to the cylinder to either increase or decrease the resistance. This interrupts the user's aerobic activity and therefore decreases the effectiveness of the exercise routine.

Therefore, it can readily be seen that there is a need in the art for a hydraulic system for an exercise apparatus that uses a compressible fluid to absorb energy. There is also a need in the art for a fluid having a more stable viscosity index, such that viscosity is maintained at elevated operating temperatures. Further, there is a need in the art for exercise equipment that is compact, relatively light weight and durable and provides an aerobic routine with user adjustable, bidirectional resistance.

SUMMARY OF THE INVENTION

To address the above-discussed deficiencies of the prior art, it is a primary object of the present invention to provide a hydraulic system for exercise equipment that provides bidirectional, adjustable resistance and that takes advantage of the viscosity and energy absorption qualities of compressible fluids.

In the attainment of the above primary object, one aspect of the present invention provides a hydraulic system for exercise equipment. The hydraulic system comprises: (1) a first piston axially reciprocable in a first cylinder, the first piston dividing an interior of the first cylinder into first and second chambers, the first cylinder having an end portion substantially sealing the first chamber of the first cylinder as against fluid communication with an environment surrounding the first cylinder, the first cylinder further having a first fluid port allowing fluid communication with the first chamber of the first cylinder, (2) a second piston axially reciprocable in a second cylinder, the second piston dividing an interior of the second cylinder into first and second chambers, the second cylinder having an end portion substantially sealing the first chamber of the second cylinder as against fluid communication with the environment, the second cylinder further having a first fluid port allowing fluid communication with the first chamber of the second cylinder, (3) an adjustable valve having a first valve fluid port coupled to the first fluid port of the first cylinder and a second valve fluid port coupled to the first fluid port of the second cylinder, the first chambers of the first and second cylinders thereby being in fluid communication, (4) means for controllably adjusting a fluid resistance of the adjustable valve and (5) a compressible fluid substantially occupying the first chambers of the first and second cylinders, the adjusting means allowing the adjustable valve to present an adjustable resistance to flow of the fluid, the fluid permitting a change in volume in the first chambers of the first and second cylinders thereby providing elastic absorption of shock forces in the fluid.

The advantage of the above arrangement is that the pistons can reciprocate back and forth, providing resistance to motion via the adjustable valve in both directions. The resistance is fully user-adjustable. Furthermore, the compressible fluid provides elastic shock absorption of potentially harmful instantaneous forces that the user may inadvertently develop while using the equipment.

In a preferred embodiment of the present invention, (1) the first cylinder has an end portion substantially sealing the second chamber of the first cylinder as against fluid communication with the environment, the first cylinder further having a second fluid port allowing fluid communication with the second chamber of the first cylinder and (2) the second cylinder has an end portion substantially sealing the second chamber of the second cylinder as against fluid communication with the environment, the second cylinder further having a second fluid port allowing fluid communication with the second chamber of the second cylinder, the second fluid port of the first cylinder coupled in fluid communication with the second port of the second cylinder.

Thus, the pistons have fluid-filled chambers on both sides thereof. This symmetry allows for selectable offset of the first and second pistons in a manner to be described.

In a preferred embodiment of the present invention, the adjusting means comprises a motor coupled to a shiftable valve member in the adjustable valve. The motor allows precise positional control of the shiftable valve member, thereby providing precise control of fluid resistance. The motor further allows advantageous remote electrical control of the adjustable valve by the user.

In a preferred embodiment of the present invention, the first and second pistons are coupled via connecting rods to lever arms of an exercise machine, the lever arms capable of rotational actuation by a user, the user thereby capable of transferring energy into the fluid via the lever arms and the first and second pistons. In this preferred embodiment, the system is part of a striding exercise machine. In a manner to be illustrated, a user can mount the lever arms, moving his arms and legs back and forth to simulate walking. The machine provides resistance to the walking via the hydraulic system, thereby exercising the limbs and body of the user.

Those of skill in the art will recognize that the present invention is equally applicable to other types of exercise equipment. In particular, equipment employing reciprocating motion can be adapted to impart energy into the first and second pistons for resistance thereby.

In a preferred embodiment of the present invention, the system further comprises a fluid reservoir maintained at a prescribed pressure, the fluid reservoir coupled to the first and second valve fluid ports via one-way valves to thereby allow fluid in the fluid reservoir to enter the first and second valve fluid ports to maintain the fluid in the first and second valve fluid ports at the prescribed pressure. In a related embodiment, the fluid reservoir is coupled to the second fluid ports of the first and second cylinders via a one-way valves to thereby allow fluid in the fluid reservoir to enter the second fluid ports of the first and second cylinders to maintain the fluid in the second fluid ports of the first and second cylinders at the prescribed pressure.

In a preferred embodiment of the present invention, the system further comprises a valve coupling the first and second fluid ports of the second cylinder to thereby allow fluid communication therebetween. This allows independent movement of the first and second pistons. In the embodiment to be illustrated, when the valve is closed, the first piston moves in opposition to the second. In other words, when the first piston is extended, the second piston is retracted, and vice versa. When the valve is open, the first and second pistons can be set to any selectable position in their stroke. Once set, the valve may be closed. Once closed, the first and second pistons again move in opposition about the selectable position. This allows a user to establish an offset in the rotational position of the lever arms of the exercise machine, primarily for the purpose of comfort.

In a preferred embodiment of the present invention, the fluid reservoir, one-way valves and adjustable valve are integrated into a single fluid control body. For purposes of compactness, cost and ease of construction, a common body is employed to contain the fluid reservoir, one-way valves, adjustable valve and some of the interconnecting hydraulic tubing. Those of skill in the art will recognize that discrete components are well within the scope of the invention, however.

In a preferred embodiment of the present invention, the compressible fluid contains silicone. As has been and will be described, silicone-based fluids have particularly attractive physical properties relating to energy absorption, durability and viscosity index. Silicone-based fluids are also inexpensive, readily available and relatively harmless.

In a preferred embodiment of the present invention, two such systems are employed in a single exercise machine. One system is used to present resistance to arm motion, the other to leg motion. The two systems are preferably independent to one another. Thus, the arms and legs of a user may be presented with different levels of resistance. Since the first and second cylinders of each system are hydraulically coupled, however, the user's arms are coupled together and the user's legs are coupled together.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
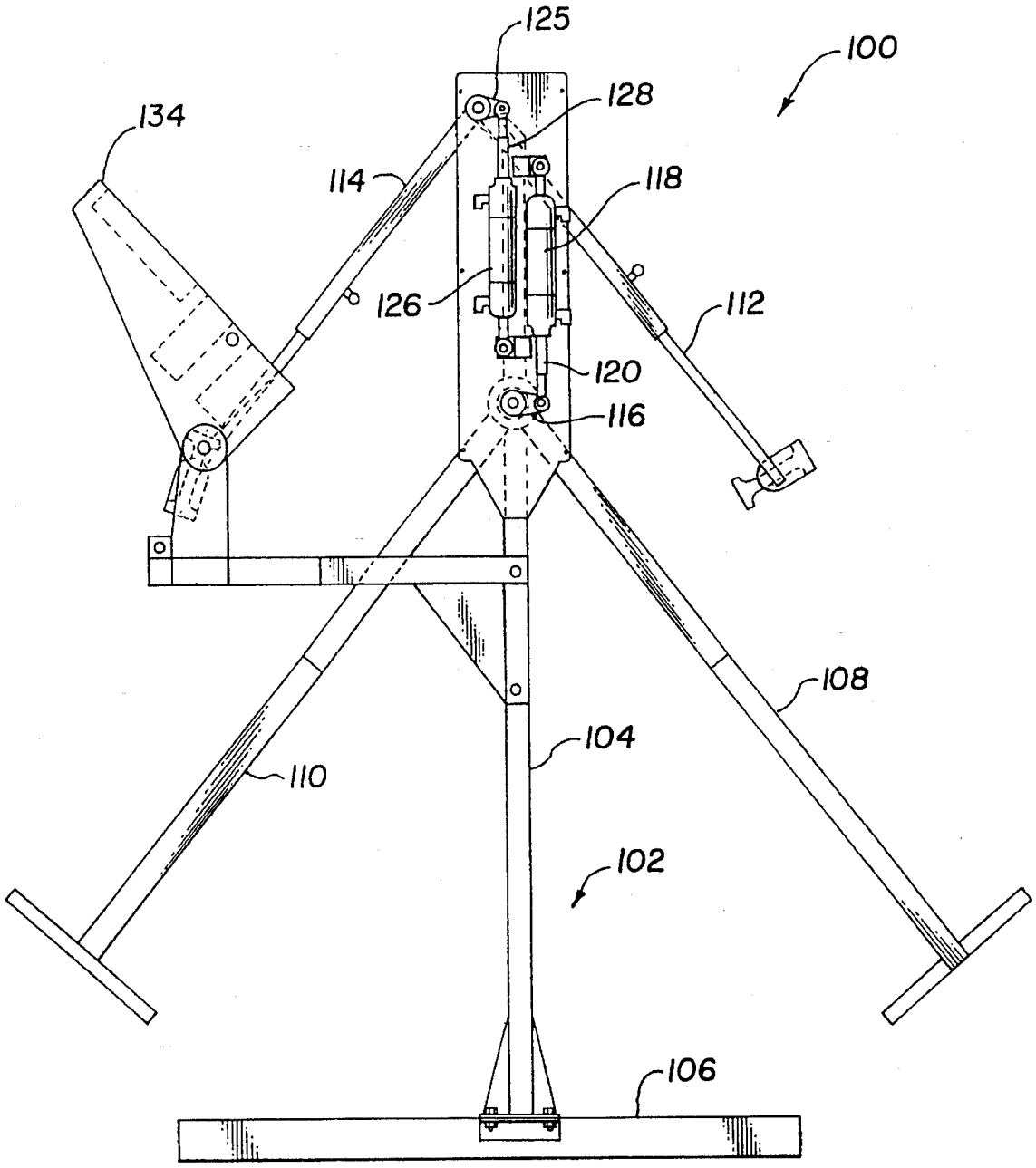
FIG. 1 illustrates a side elevational view of an exercise machine incorporating the hydraulic system of the present invention.
Figure 1A:
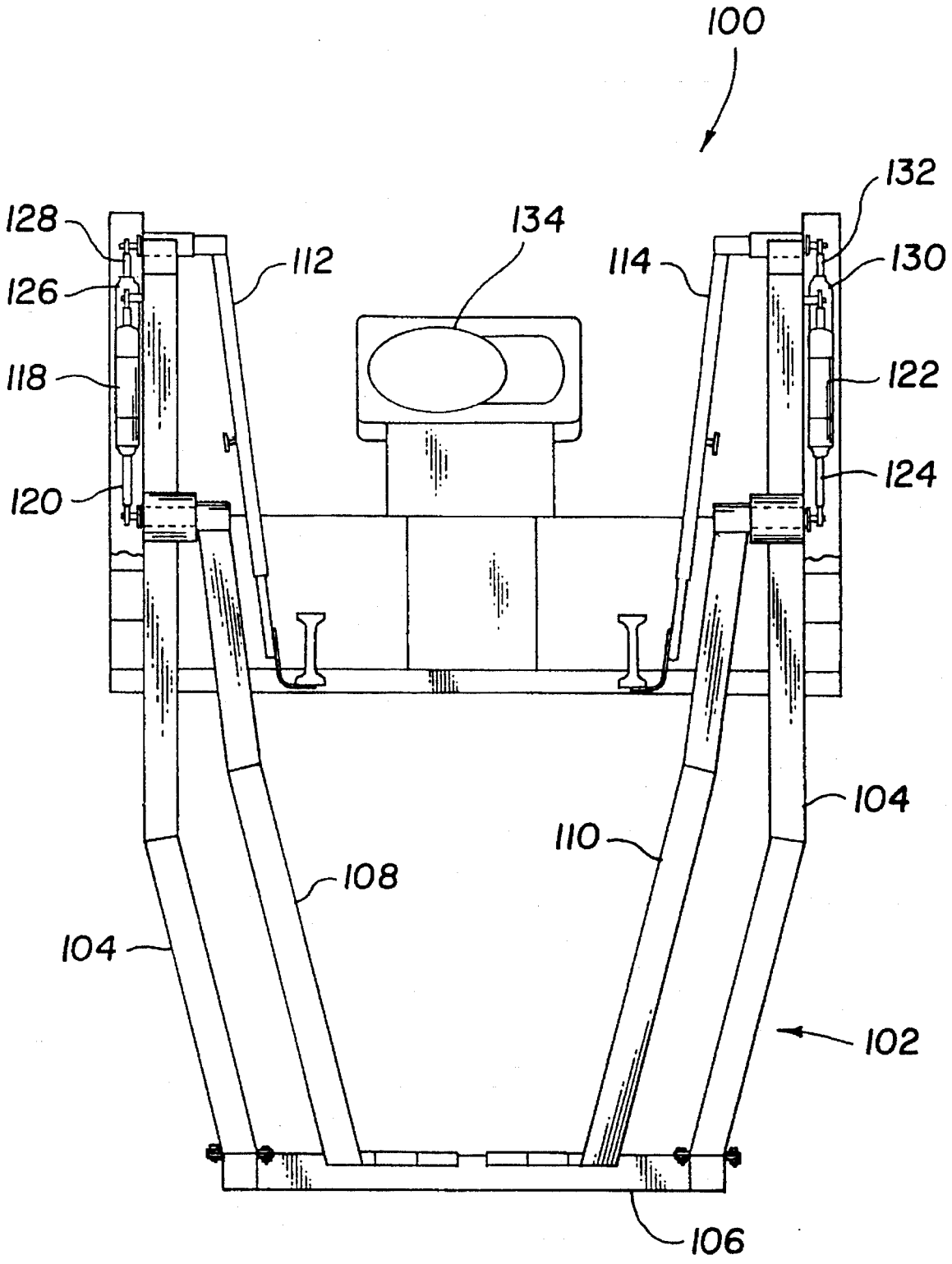
FIG. 1A illustrates a rear side elevational view of the exercise machine of FIG. 1.

Referring initially to FIGS. 1 and 1A, illustrated is an exercise machine 100 that may incorporate the hydraulic system of the present invention. The exercise machine 100 is comprised of a frame 102 having first and second spaced support members 104 and 106. A first leg member 108 and a second leg member 110 are pivotally mounted to the support member 104 as illustrated. Also mounted to the support member 104 are a first arm member 112 and a second arm member 114. The leg members 108 and 110 and the arm members 112 and 114 may also be individually referred to herein as "lever arms." The lever arms may be adjustable to accommodate the arm and leg length of various users. A cantilevered member 116 couples the first leg lever member 108 to a first leg piston/cylinder assembly 118 via a rod member 120 that allows the first leg lever member 108 to extend the rod 120 when the first leg lever member 108 is moved back and forth. The second leg lever member 110 is coupled, also by a cantilevered member (not shown), to a second leg piston/cylinder assembly 122 via a rod member 124 that allows the second leg lever member 110 to extend the rod 124 when the second leg lever member 110 is moved back and forth. The first leg piston/cylinder assembly 118 is connected to and in fluid communication with the second leg piston/cylinder assembly 122 via the hydraulic resistance system and fluid conduit, as hereinafter described.

A cantilevered member 125 couples the first arm lever member 112 to a first arm piston/cylinder assembly 126 via a rod member 128 that allows the first arm lever member 112 to extend the rod 128 and thus move the piston in a reciprocating fashion within the cylinder when the first arm lever member 112 is moved back and forth. Likewise, a cantilevered member (not shown) couples the second arm lever member 114 to a second arm piston/cylinder assembly 130 via a rod member 132 that allows the second arm lever member 114 to extend the rod 132 and thus move the piston in a reciprocating fashion within the cylinder when the second arm lever member 114 is moved back and forth. The first arm piston/cylinder assembly 126 is connected to and in fluid communication with the second arm piston/cylinder assembly 130 via the hydraulic resistance system and fluid conduit, as hereinafter described.

Also attached to the support member 104 is a control console/display module 134 from which the user may easily vary the resistance of the respective hydraulic resistance systems. Preferably, the control console/display module 136 utilizes a microprocessor (not shown) interfaced with an input interface (not shown) to input and retrieve data related to the exercise routine. From the control console/display module 136, the user may obtain various types of exercise output information related to the exercise routine, such as distance traveled, pulse rate attained, calories burned (or wattage expended) or time remaining in the routine. The caloric or wattage information may be supplied as whole-body totals or broken down into separate quantities for arms and legs. Additionally, the user may input data into the control console/display module, such as the user's weight, the time interval for conducting the exercise routine or the desired amount of resistance.

Those of skill in the art will realize that the hydraulic system of the present invention may also be incorporated to an advantage in exercise machines employing linear movement, such as cross-country ski machines, or to machines adapted for lifting exercise, such as well-known rack weight machines.

Figure 2:
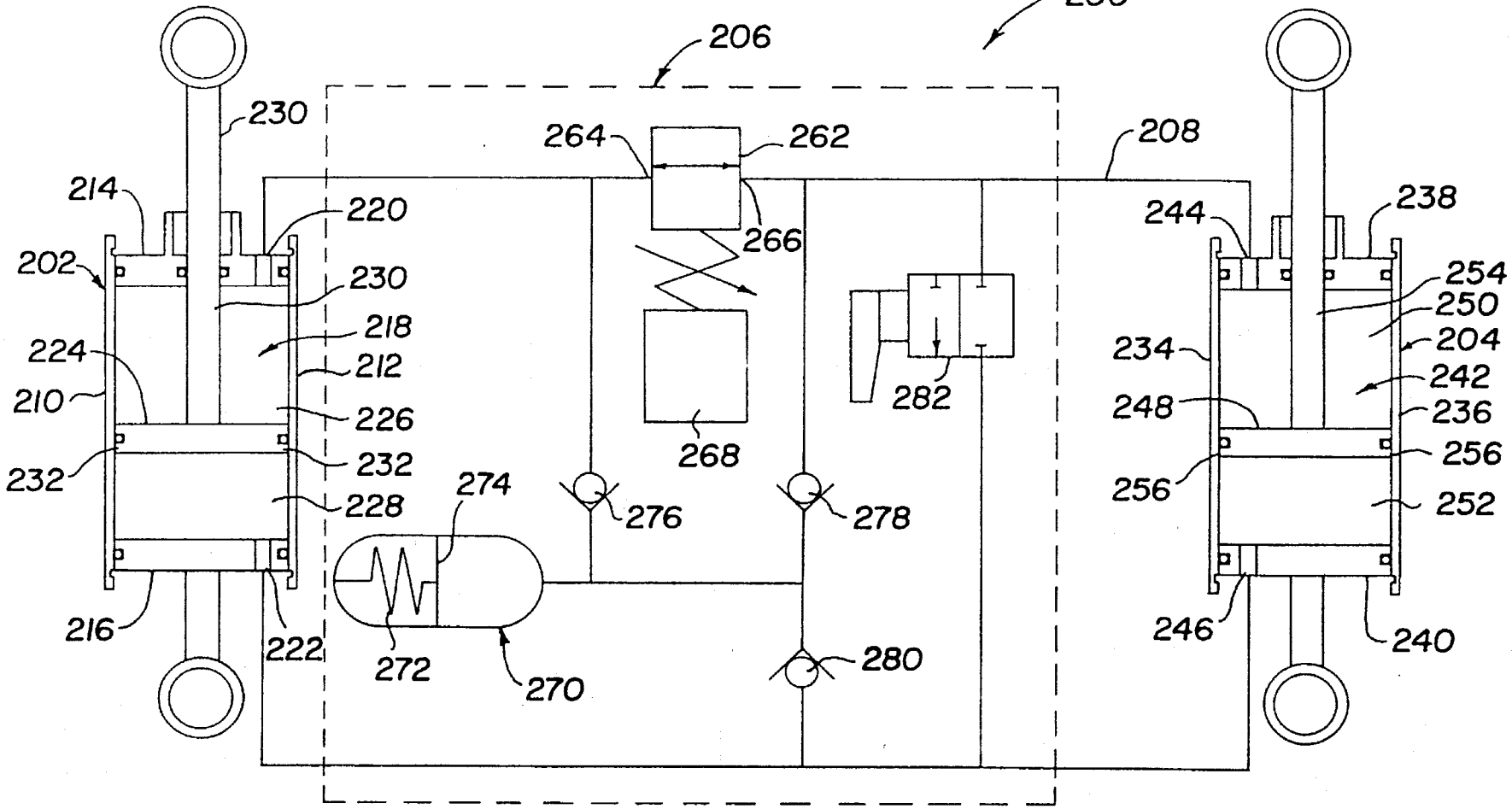
FIG. 2 illustrates a block diagram of the hydraulic system of the present invention in a static state having two opposing cylinders with an adjustable valve system incorporated therein.

Turning now to FIG. 2, illustrated is a block diagram of the hydraulic system 200 of the present invention in a static state. The hydraulic system 200 is substantially charged, under a prescribed pressure, with a compressible fluid, preferably a silicone-based compressible fluid. Such compressible fluids have been used to a substantial advantage in a wide range of devices, such as in liquid springs, as disclosed in U.S. Pat. No. 5,152,547 and incorporated herein by reference. The preferred compressible fluid is an energy-absorbing fluid that has a stable viscosity index (substantially maintains its viscosity over a wide range of operating temperature). The fluid is also capable of dissipating heat more effectively than conventional non-compressible hydraulic fluids. Moreover, heat is further dissipated from the fluid to the frame via the various components of the system and the extensive conduit system interconnecting the components of the system as hereinafter described.

In a preferred embodiment, the hydraulic system 200 is comprised of a first cylinder member 202 in fluid communication with a second cylinder member 204 via an adjustable valve system 206, designated by a dashed line and a fluid conduit 208, both of which are schematically represented. Preferably, the first cylinder member 202 has opposing side wall portions 210 and 212 and opposing end wall portions 214 and 216 that form an interior portion 218 of the first cylinder member 202. The two opposing end wall portions 214 and 216 each have fluid ports 220 and 222 formed therethrough that connect the interior portion 218 to the fluid conduit 208, as illustrated. While two opposing end wall portions are illustrated, it will be appreciated that the cylinder could have only one end wall portion with one fluid port formed therethrough.

A first piston member 224 that divides the interior portion 218 into first and second chambers 226 and 228, is slidably positioned within the interior portion 218 to reciprocate therein. Attached to the first piston member 224 is the rod member 230 that extends outwardly through an end wall portion of the first cylinder member 202. Outer side wall portions 232 of the first piston member 224 engage the interior sides of side wall portions 210 and 212 of the first cylinder member 202 effectively to seal the first chamber 226 from the second chamber 228, thereby preventing the compressible fluid from passing therebetween.

Further included in the hydraulic system 200 of the present invention is the second cylinder member 204 in fluid communication with the first cylinder member 202, the adjustable valve system 206, and the fluid conduit 208. Preferably, the second cylinder member 204 has opposing side wall portions 234 and 236 and opposing end wall portions 238 and 240 that form an interior portion 242 of the second cylinder member 204. The two opposing end wall portions 238 and 240 each have fluid ports 244 and 246 formed therethrough that connect the interior portion 242 of the second cylinder member 204 to the fluid conduit 208, as illustrated. While two opposing end wall portions are illustrated, it will, of course, be appreciated that the second cylinder member could have only one end wall portion with one fluid port formed therethrough.

A second piston member 248 that divides the interior portion 242 into first and second chambers 250 and 252, is slidably positioned within the interior portion 242 to reciprocate therein. Attached to the second piston member 248 is the rod member 254 that extends outwardly through an end wall portion of the second cylinder member 204. Outer side wall portions 256 of the second piston member 248 engage the interior sides of side wall portions 258 and 260 to effectively seal the first chamber 250 from the second chamber 252, thereby preventing the compressible fluid from passing therebetween. The system as just described in the preceding paragraphs essentially forms two closed fluid circuits, a primary loop that includes the adjustable valve system 206 and a secondary loop that interconnects the second chambers of the first and second cylinders 202 and 204. Of course, it will be appreciated that in those embodiments where the cylinder members have only one end wall and one fluid part, only the primary loop will be formed.

A shiftable adjustable valve 262, that will hereinafter be described in detail, is also included in the hydraulic system 200. The adjustable valve 262 has a first valve fluid port 264 coupled to the first fluid port 220 of the first cylinder member 202 and a second valve fluid port 266 coupled to the first fluid port 244 of the second cylinder member 204, thereby allowing the first and second cylinders 202 and 204 to be in fluid communication with each other. The adjustable valve 262 further includes a means 268 for controllably adjusting a fluid resistance of the adjustable valve 262. The means 268 may be a threaded handle or knob that can be manually turned to adjust the adjustable valve 262. Preferably however, the means 268 comprises an electric motor that is mechanically connected to the adjustable valve 262 (in a manner to be described) and that is automatically controllable from the programmable microprocessor located in the control console 134. (see FIG. 1). The electric motor can be electronically instructed, by the user via the control console, to adjust the adjustable valve 262 and thereby vary the resistance of the hydraulic system, even while the user is engaged in the exercise routine.

The hydraulic system 200 may also include a fluid reservoir 270 maintained at a prescribed fluid pressure of the hydraulic system 200. The fluid reservoir 270 includes a spring member 272 that is biased against a piston member 274 having sides that sealingly and slidably engage the interior wall of the fluid reservoir 270. The spring member 272 has a spring force (related to its spring constant k) that is counterbalanced by the fluid pressure of the hydraulic system under normal operating conditions. The fluid reservoir 272 is coupled to and may be in fluid communication with the first and second adjustable valve ports 264 and 266 by one-way or check valves 276, 278 and 280. When the check valve 276 is in an open position, the fluid from the fluid reservoir 270 flows to the first fluid port 220 in the first cylinder member 202 and thereby maintains the prescribed fluid pressure in the system. Additionally, however, the fluid reservoir 270 is coupled to and may be in fluid communication with the second fluid ports 222 and 246 of the first and second cylinders 202 and 204 via check valve 280 to thereby allow fluid in the fluid reservoir 270 to enter the second fluid ports 222 and 246 and thereby maintain the prescribed fluid pressure in those ports, assuming a sealing system of a positive pressure at all times during dynamic operation.

In addition, a manual valve 282 is preferably included in the hydraulic system 200 of the present invention. The manual valve 282 is preferably connected with the first and second ports 220,244,222 and 246 of the first and second cylinders 202 and 204. When opened, the manual valve 282 allows fluid communication between the first and second fluid ports 220, 244, 222 and 246.

While the various components discussed in the preceding paragraphs may be separate components interconnected via the conduit 208, a preferred embodiment incorporates the adjustable valve 262, the fluid reservoir 270, the check valves 276,278 and 280 and the manual valve 282 into the single adjustable valve system 206 as schematically illustrated.

Figure 2A:
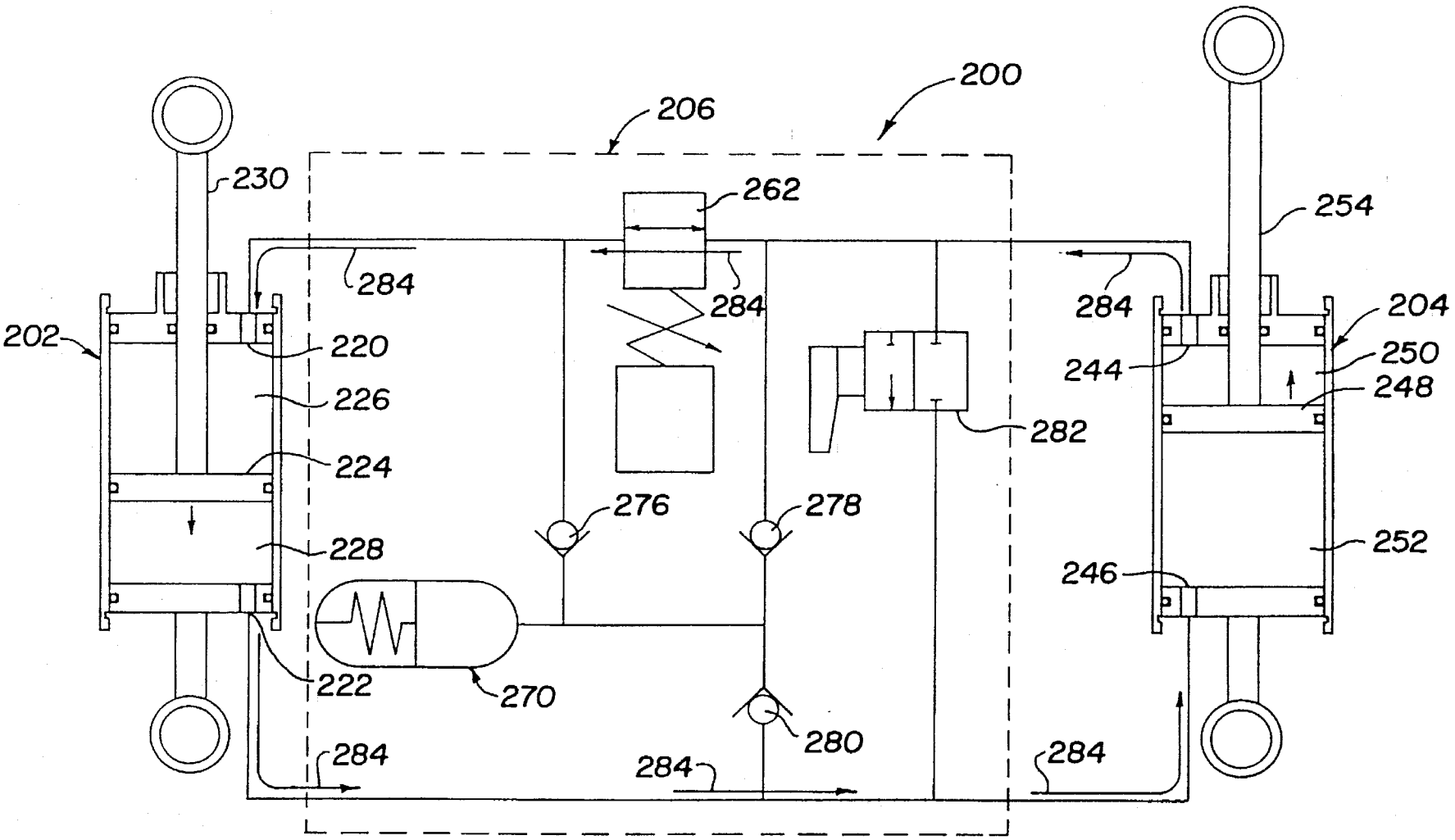
FIG. 2A illustrates a block diagram of the hydraulic system of FIG. 2 in a dynamic state and of flows paths of compressible hydraulic fluid therein.

Turning now to FIG. 2A, illustrated is a block diagram of the hydraulic system 200 of the present invention in a dynamic state with the fluid flow path 284 of the compressible hydraulic fluid shown. When the first piston 224 is forced toward the second fluid port 222 in the first cylinder member 202 by the user via the rod member 230, the second piston 248 in the second cylinder member 204 is simultaneously moved by the user via the rod member 254 in a direction opposite that of the first piston 224, e.g. toward the first fluid port 244 in the second cylinder member 204. As a result, fluid in the first chamber 250 of the second cylinder member 204 exists through the first port 244 and passes through the adjustable valve 262 that thereby creates a resistance in the flow of the fluid. Fluid exits the adjustable valve 262 and flows into the first chamber 226 of the first cylinder member 202 via the first fluid port 220. Simultaneously, fluid in the second chamber 228 of the first cylinder member 202 exits via the second fluid port 222 and enters the second chamber 252 of the second cylinder member 204 via the second fluid port 246. As illustrated, the fluid reservoir 270, the check valves 276,278 and 280 and the manual valve 282 are in the closed position under normal operating conditions.

It is apparent in FIG. 2A that operation of the first and second pistons 224,248 is fully reversible, i.e., that when one is moved in one direction, the other is moved in an opposite direction. In either direction, the adjustable valve 262 presents resistance to fluid flow. The hydraulic system 200 is thereby bidirectional.

Figure 2B:
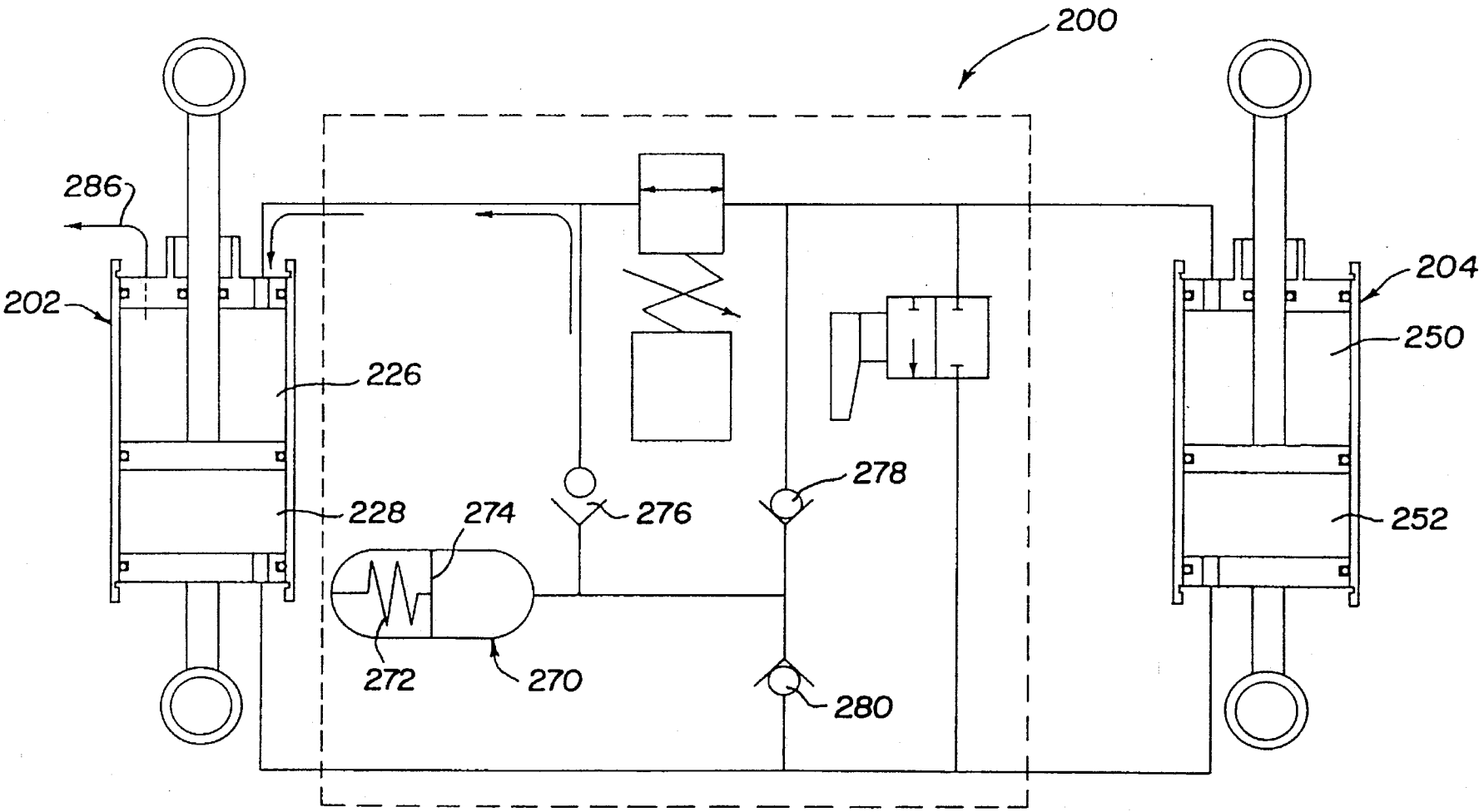
FIG. 2B illustrates a block diagram of the hydraulic system of FIG. 2 in a static state and the actuation of a fluid reservoir and check valve in response to a leak in one of the cylinders and of the flow path of the compressible hydraulic fluid associated therewith.

Turning now to FIG. 2B, illustrated is a block diagram of the hydraulic system 200 of the present invention in a static state in which the fluid reservoir 270 and check valve 276 have been actuated in response to a fluid volume change (such as a leak 286) in the first cylinder member 202. When a fluid leak occurs in the hydraulic system 200, the prescribed fluid pressure of the system decreases below the spring member's 272 biasing force. The spring member 272 is then able to push against the piston member 274 and force fluid from the fluid reservoir 270 and unseat the check valve 276. The fluid then flows, as illustrated, into the first chamber 226 of the first cylinder member 202 in an attempt to re-establish the prescribed fluid pressure of the system. It should, of course, be appreciated that if the leak occurs in the first chamber 250 of the second cylinder member 204, then the pressure exerted by the fluid in the fluid reservoir 270 unseats the check valve 278 to thereby allow fluid to flow into the first chamber 250 of the second cylinder member 204. It should also be appreciated that if a leak occurs in either of the second chambers 228 or 252 of the first or second cylinder members 202 or 204, then the pressure exerted by the fluid in the fluid reservoir 270 unseats the check valve 280 to thereby allow fluid to flow into the chamber in which the leak occurs.

Figure 2C:
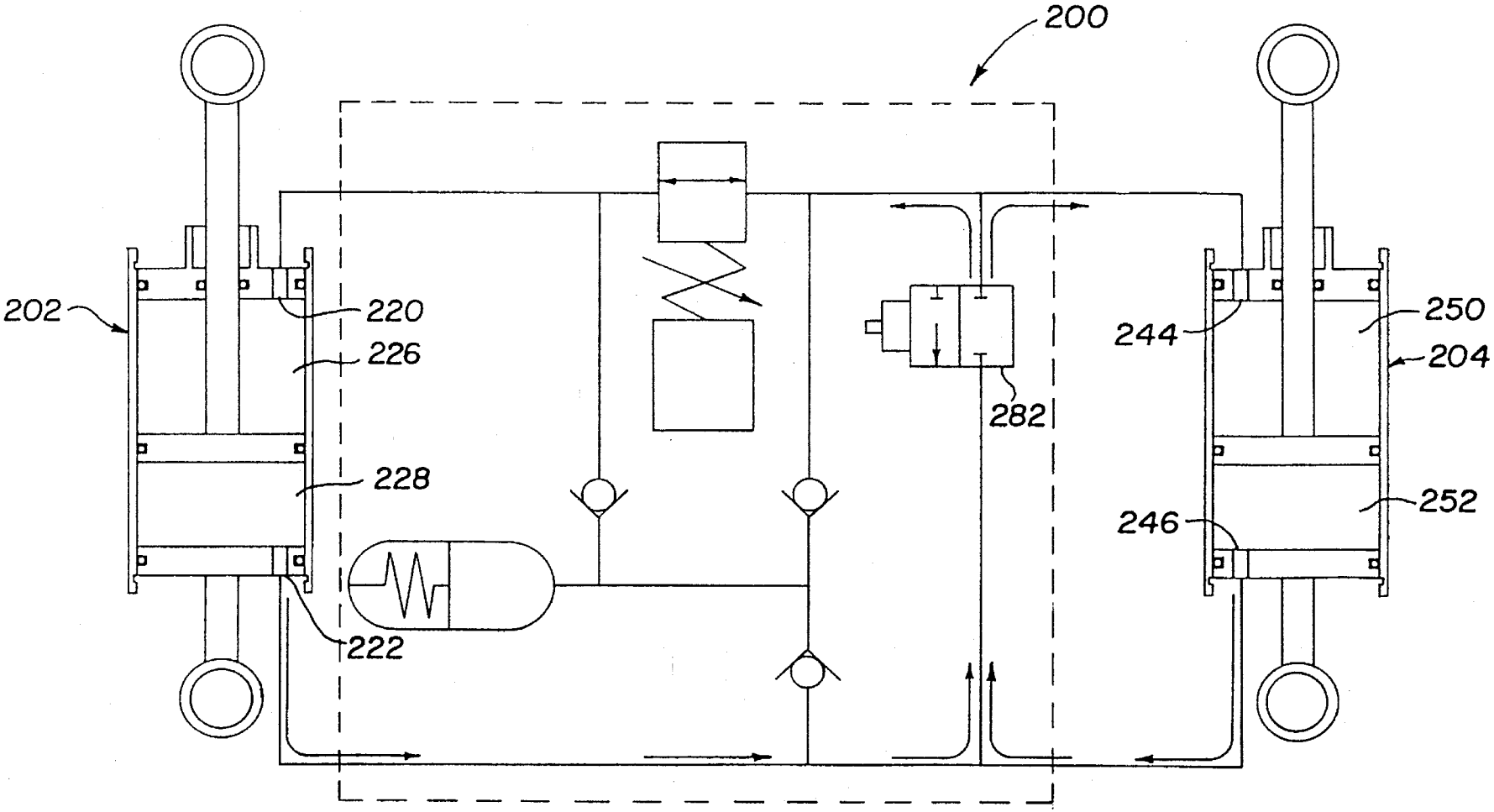
FIG. 2C illustrates a block diagram of the hydraulic system of FIG. 2 in a static state with the manual valve in an open position and of the flow path of the compressible fluid associated therewith.

Turning now to FIG. 2C, illustrated is a block diagram of the hydraulic system 200 of the present invention in a static state with the manual valve 282 in an open position. When the manual valve 282 is in the open position, the previously-described primary fluid loop and the secondary fluid loop are in fluid communication with each other, as illustrated. As such, the user is able to adjust the angle of the lever arms' starting position with respect to the support member without encountering substantial resistance. Once the desirable angle is achieved, the manual valve 282 is then closed, thereby isolating the primary loop from the secondary loop. The system is then ready to be used in the exercise routine.

Figure 3:
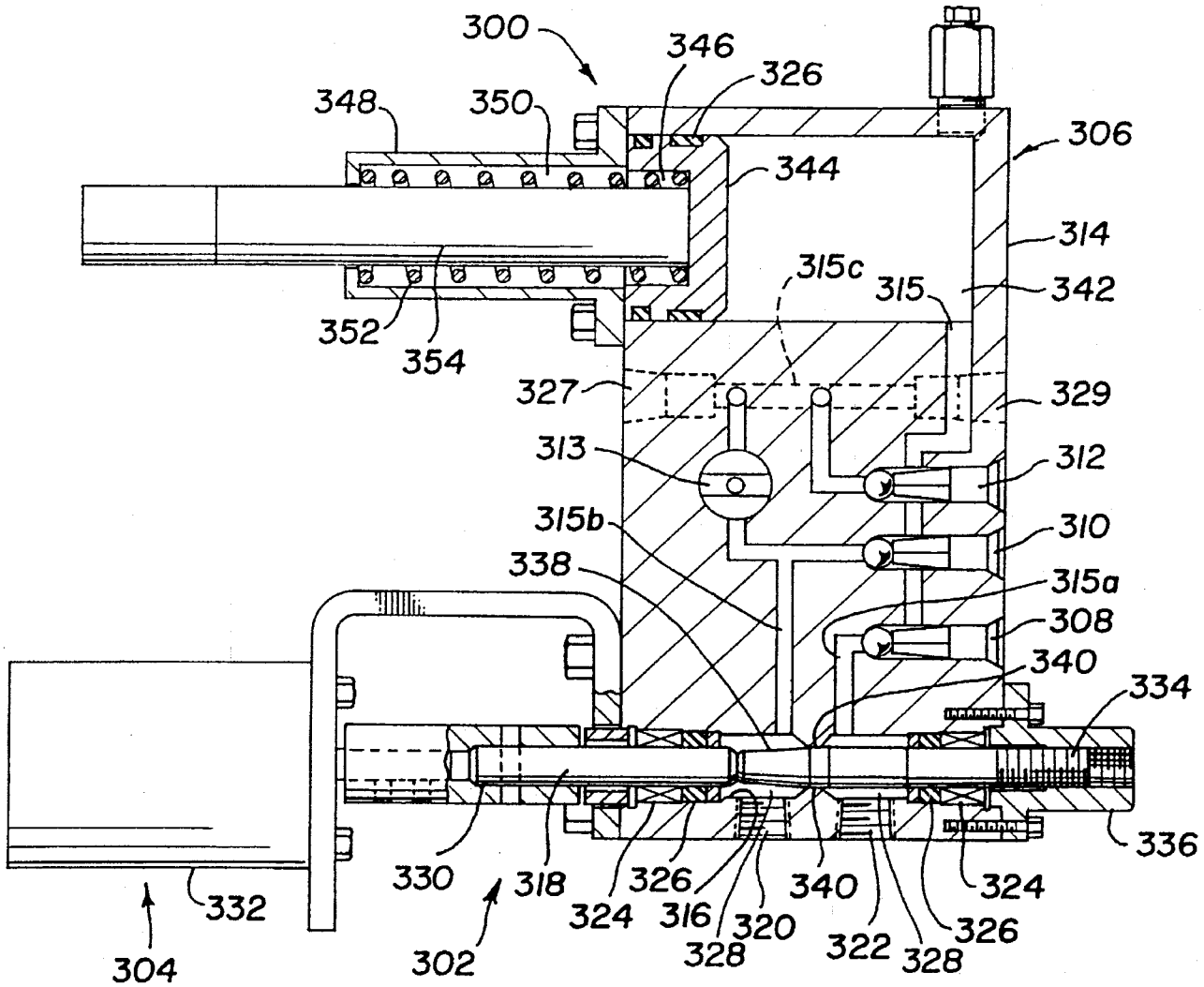
FIG. 3 illustrates a cross-sectional view of an integrated adjustable valve system embodying a portion of the hydraulic system depicted in FIG. 2.

Turning now to FIG. 3, illustrated, in a preferred embodiment thereof, is a cross-sectional view of the adjustable valve system 300 with the adjustable valve 302, a means 304 for controllably adjusting the fluid resistance of the adjustable valve, the fluid reservoir 306, check valves 308, 310 and 312, the manual valve 313, and the conduit system 315 interconnecting the various components adjustable valve system 300 to the hydraulic system 300, as also illustrated in the schematic block diagrams of FIGS. 2 and 2A–2C and discussed above.

The adjustable valve system 300 is comprised of a housing manifold 314 having a valve rod passageway 316 formed therethrough through which an adjustable valve rod 318 is positioned. A first fluid port 320 and second fluid port 322 are formed in a side of the manifold housing 314 adjacent to and intersecting with the passageway 316. The first fluid port 320 may be connected via the conduit 315 to the first cylinder (see FIG. 2) and the second fluid port 322 may be connected via the conduit 315 to the second cylinder (see FIG. 2).

The valve rod 318 is positioned through the passageway 316 and is maintained in an operative position within the passageway 316 by sleeve bearing members 324. Positioned adjacent to the bearing members 324 and around the valve rod 318 are seal members 326 that sealingly form a fluid passageway portion 328 within the passageway 316, which is in fluid communication with the first and second fluid ports 320 and 322.

The valve rod 318 has a first end 330 that projects outwardly from the housing manifold 314 and connects with an electric motor 332 and cooperating gears (not shown) that are capable of rotating and thereby axially displacing the valve rod 318 in small predetermined increments. The valve rod 318 has a threaded second end 334 that is received in a cooperatively threaded cap member 336 that is secured to the housing manifold 314. The valve rod 318 has a tapered portion 338 that extends the length of the fluid passageway 328.

Projecting outwardly from the interior wall of the passageway 316 within the fluid passageway 328 and adjacent the first and second fluid ports 320 and 322 are aligned opposing shoulder portions 340. When the valve rod 318 is in a closed position, the shoulder portions 340 sealingly engage the side wall of the valve rod 318, as illustrated. However, when the valve rod 318 is rotated by the motor 332, the valve rod 318 is axially displaced by the threaded end 334 rotating into the threaded cap member 336. The axial displacement the valve rod 318 causes the tapered portion 338 of the valve rod 318 to be axially displaced toward the shoulder portions 340. As a result, the shoulder portions 340 no longer sealingly engage the side wall of the valve rod 318 and thus, fluid can then flow in and out of the fluid passageway 328 via the first or second fluid ports 320 and 322.

Also formed within the housing manifold 314 is the generally cylindrically shaped fluid reservoir 342 having an end opening outwardly from the housing manifold 314 that is interconnected with the first fluid ports 321 and 323 of the cylinders and the check valves 308,310 and 312 via the conduit 315. The fluid reservoir 342 is filled with the compressible fluid used in the hydraulic system 300 and is maintained by the same pressure as the hydraulic system 300. Received within the fluid reservoir 342 is the piston member 344. The piston member 344 is slidably engaged against the side walls of the fluid reservoir 342 and is sealed against the side walls by a seal member 326. The piston member 334 has a hollow portion 346 formed therein that opens outwardly from the fluid reservoir 342. A cap member 348 is secured to the housing manifold 314 over the fluid reservoir 342 and the piston member 344 to thereby form a cavity 350 in which the spring member 352 is received. Also received within the cavity 350 is a color coded indicator member 354. When a leak occurs in the system as previously discussed, the pressure drop within the system causes a check valve to unseat and allows fluid to flow from the fluid reservoir 342. The spring member 352 urges the piston 344 toward the closed end of the fluid reservoir 342, and the indicator member 354 is gradually drawn into the interior portion of the fluid reservoir 342, thereby exposing the color which indicates that the fluid level in the fluid reservoir 342 is low.

Also included within the preferred adjustable valve system 300 are check valves 308, 310 and 312. The check valves 308, 310 and 312 are in fluid communication with the fluid reservoir 342 via the conduit 315. Check valves 308 and 310 are in fluid communication with the fluid ports 321 and 323 of the first and second cylinders through the fluid passageway 328 of the valve rod 318 and through the conduits 315*a* and 315*b*, respectively, as illustrated in FIG. 2. The manual valve 313 is in fluid communication with the first fluid ports 321 and 323 of the cylinder members through the fluid passageway 328 and the conduit 315*b*. Additionally however, the manual valve 313 and the check valve 312 are in fluid communication with the second fluid ports 327 and 329 of the first and second cylinders via conduit 315*c*.

With the hydraulic system of the present invention having been described, a brief description of the operation of the system will now be discussed. The user steps onto the exercise machine and inputs the desired exercise parameters, such as the desired amount of resistance, in the microprocessor within the control console/display module. When the resistance is electronically set, the software within the microprocessor actuates the motor which rotates the valve rod and incrementally adjusts the tapered portion of the valve rod in an axial direction to the appropriate position to thereby create an opening between the shoulder portion and the valve rod that corresponds to the desired amount of resistance.

The user correctly positions his arms and legs in the arm and leg levers of the machine and begins the exercise routine by swinging his right leg and left arm forward and his left leg and right arm backward in a natural walking motion. Via the cantilevered members, the swinging motion of the lever arms either extend or depress the rod members on the cylinders, depending on which direction the lever arm is being swung. As this is done, the compressible fluid flows through the system as previously described and shown in FIG. 2A and through the restricted opening in the adjustable valve rod, thereby creating the resistance against the user.

The user may continue the routine until the display module indicates that the pre-set time has lapsed. The operation of the fluid reservoir and the manual valve has been previously described above and will not be repeated here.

From the above, it is apparent that the present invention provides a exercise machine, a hydraulic system for exercise equipment and a method of providing resistance to piston motion in exercise equipment. The hydraulic system comprises: (1) a first piston axially reciprocable in a first cylinder, the first piston dividing an interior of the first cylinder into first and second chambers, the first cylinder having an end portion substantially sealing the first chamber of the first cylinder as against fluid communication with an environment surrounding the first cylinder, the first cylinder further having a first fluid port allowing fluid communication with the first chamber of the first cylinder, (2) a second piston axially reciprocable in a second cylinder, the second piston dividing an interior of the second cylinder into first and second chambers, the second cylinder having an end portion substantially sealing the first chamber of the second cylinder as against fluid communication with the environment, the second cylinder further having a first fluid port allowing fluid communication with the first chamber of the second cylinder, (3) an adjustable valve having a first valve fluid port coupled to the first fluid port of the first cylinder and a second valve fluid port coupled to the first fluid port of the second cylinder, the first chambers of the first and second cylinders thereby being in fluid communication, (4) means for controllably adjusting a fluid resistance of the adjustable valve and (5) a compressible fluid substantially occupying the first chambers of the first and second cylinders, the adjusting means allowing the adjustable valve to present an adjustable resistance to flow of the fluid, the fluid permitting a change in volume in the first chambers of the first and second cylinders thereby providing elastic absorption of shock forces in the fluid.

Although the present invention and its advantages have been described in detail, those skilled in the art should understand that they can make various changes, substitutions and alterations herein without departing from the spirit and scope of the invention in its broadest form.

What is claimed is:

1. A hydraulic system for exercise equipment, comprising:

a first piston axially reciprocable in a first cylinder, said first piston dividing an interior of said first cylinder into first and second chambers, said first cylinder having an end portion substantially sealing said first chamber of said first cylinder as against fluid communication with an environment surrounding said first cylinder, said first cylinder further having a first fluid port allowing fluid communication with said first chamber of said first cylinder, said first cylinder having an end portion substantially sealing said second chamber of said first cylinder as against fluid communication with said environment, said first cylinder further having a second fluid port allowing fluid communication with said second chamber of said first cylinder;

a second piston axially reciprocable in a second cylinder, said second piston dividing an interior of said second cylinder into first and second chambers, said second cylinder having an end portion substantially sealing said first chamber of said second cylinder as against fluid communication with said environment, said second cylinder further having a first fluid port allowing fluid communication with said first chamber of said second cylinder, said second cylinder has an end portion substantially sealing said second chamber of said second cylinder as against fluid communication with said environment, said second cylinder further having a second fluid port allowing fluid communication with said second chamber of said second cylinder, said second fluid port of said first cylinder coupled in fluid communication with said second port of said second cylinder;

an adjustable valve having a first valve fluid port coupled to said first fluid port of said first cylinder and a second valve fluid port coupled to said first fluid port of said second cylinder, said first chambers of said first and second cylinders thereby being in fluid communication;

means for controllably adjusting a fluid resistance of said adjustable valve; and a compressible fluid substantially occupying said first chambers of said first and second cylinders, said adjusting means allowing said adjustable valve to present an adjustable resistance to flow of said fluid, said fluid permitting a change in volume in said first chambers of said first and second cylinders thereby providing elastic absorption of shock forces in said fluid.

2. The system as recited in claim 1 wherein said adjusting means comprises a motor coupled to a shiftable valve member in said adjustable valve.

3. The system as recited in claim 1 wherein said first and second pistons are coupled via connecting rods to lever arms of an exercise machine for rotational actuation by a user, thereby allowing a user to transfer energy into said fluid via said lever arms and said first and second pistons.

4. The system as recited in claim 1 further comprising a fluid reservoir maintained at a prescribed pressure, said fluid reservoir coupled to said first and second valve fluid ports via one-way valves to thereby allow fluid in said fluid reservoir to enter said first and second valve fluid ports to maintain said fluid in said first and second valve fluid ports at said prescribed pressure.

5. The system as recited in claim 1 further comprising a fluid reservoir maintained at a prescribed pressure, said fluid reservoir coupled to said second fluid ports of said first and second cylinders via a one-way valves to thereby allow fluid in said fluid reservoir to enter said second fluid ports of said first and second cylinders to maintain said fluid in said second fluid ports of said first and second cylinders at said prescribed pressure.

6. The system as recited in claim 1 further comprising a valve coupling said first and second fluid ports of said second cylinder to thereby allow fluid communication therebetween.

7. The system as recited in claim 4 wherein said fluid reservoir, one-way valves and adjustable valve are integrated into a single fluid control body.

8. The system as recited in claim 1 wherein said compressible fluid contains silicone.

9. An exercise machine, comprising:

a frame having first and second spaced support members;

two leg members pivotally mounted to respective ones of said support members;

two arm members pivotally mounted to said respective ones of said support members above said leg members, said arm and leg members vertically spaced so that said leg members are associated with hips of a user and said arm members are associated with shoulders of said user;

two leg piston/cylinder assemblies coupled to said respective ones of said two leg members, said pistons of said two leg piston/cylinder assemblies axially slidable in said cylinders between an extended position and a retracted position in response to pivotal motion of said two leg members;

two arm piston/cylinder assemblies coupled to said respective ones of said two arm members, said pistons of said two arm piston/cylinder assemblies axially slidable in said cylinders between an extended position and a retracted position in response to pivotal motion of said two arm members;

a leg hydraulic resistance system including a leg adjustable resistance valve coupling said pistons of said two leg piston/cylinder assemblies in opposition, such that, when one of said two leg piston/cylinder assembly pistons is in said extended position, another of said two leg piston/cylinder assembly pistons is in a retracted position, said leg hydraulic resistance system containing a compressible fluid, said leg adjustable resistance valve providing variable resistance to said compressible fluid; and an arm hydraulic resistance system including an arm adjustable resistance valve coupling said pistons of said two arm piston/cylinder assemblies in opposition, such that, when one of said two arm piston/cylinder assembly pistons is in said extended position, another of said two arm piston/cylinder assembly pistons is in a retracted position, said arm hydraulic resistance system containing said compressible fluid, said arm adjustable resistance valve providing variable resistance to said compressible fluid.

10. The machine as recited in claim 9 wherein each of said pistons of said two leg and arm piston/cylinder assemblies divide an interior of each of said cylinders of said two leg and arm piston/cylinder assemblies into first and second chambers, each of said cylinders having end portions substantially sealing said first and second chambers of said cylinders as against fluid communication with an environment surrounding said cylinders, each of said cylinders further having fluid ports allowing fluid communication with said first and second chambers of said cylinders.

11. The machine as recited in claim 10 further comprising means for controllably adjusting a fluid resistance of said leg and arm adjustable resistance valves.

12. The machine as recited in claim 11 wherein said adjusting means comprises motors coupled to respective shiftable valve members in said leg and arm adjustable resistance valves.

13. The machine as recited in claim 10 further comprising fluid reservoirs maintained at prescribed pressures coupled to each of said leg and arm hydraulic resistance systems via one-way valves to thereby allow fluid in said fluid reservoirs to enter said leg and arm hydraulic resistance systems to maintain said fluid in said leg and arm hydraulic resistance systems at said prescribed pressures.

14. The machine as recited in claim 10 further comprising means for allowing said two arm members and said two leg members to pivot independently.

15. The machine as recited in claim 14 wherein said fluid reservoirs, one-way valves and leg and arm adjustable resistance valves are integrated into two fluid control bodies.

16. The machine as recited in claim 10 wherein said compressible fluid contains silicone.

17. The machine as recited in claim 10 further comprising an electronic control system for controlling said leg and arm adjustable resistance valves.

18. A method of providing resistance to piston motion in exercise equipment, comprising the steps of:

axially reciprocating a first piston in a first cylinder, said first piston dividing an interior of said first cylinder into first and second chambers, said first cylinder having an end portion substantially sealing said first chamber of said first cylinder as against fluid communication with an environment surrounding said first cylinder, said first cylinder further having a first fluid port allowing fluid communication with said first chamber of said first cylinder, said first cylinder having an end portion substantially sealing said second chamber of said first cylinder as against fluid communication with said environment, said first cylinder further having a second fluid port allowing fluid communication with said second chamber of said first cylinder;

axially reciprocating a second piston in a second cylinder, said second piston dividing an interior of said second cylinder into first and second chambers, said second cylinder having an end portion substantially sealing said first chamber of said second cylinder as against fluid communication with said environment, said second cylinder further having a first fluid port allowing fluid communication with said first chamber of said second cylinder;

allowing fluid communication between said first chambers of said first and second cylinders with an adjustable valve having a first valve fluid port coupled to said first fluid port of said first cylinder and a second valve fluid port coupled to said first fluid port of said second cylinder, said second cylinder having an end portion substantially sealing said second chamber of said second cylinder as against fluid communication with said environment, said second cylinder further having a second fluid port allowing fluid communication with said second chamber of said second cylinder, said second fluid port of said first cylinder coupled in fluid communication with said second port of said second cylinder;

controllably adjusting a fluid resistance of said adjustable valve; and permitting a change in volume in said first chambers of said first and second cylinders with a compressible fluid substantially occupying said first chambers of said first and second cylinders, said adjusting means allowing said adjustable valve to present an adjustable resistance to flow of said fluid, said fluid thereby providing elastic absorption of shock forces in said fluid.

* * * * *